US005943542A

United States Patent [19]

Dalal et al.

[11] Patent Number: 5,943,542

[45] Date of Patent: Aug. 24, 1999

[54] DUAL LEVELS OF FUNCTIONAL AND NON-REACTIVE RELEASE AGENTS FOR FUSERS

[75] Inventors: Edul N. Dalal, Webster; Robert J. Gruber, Pittsford; Rabin Moser, Victor, all of N.Y.

[73] Assignee: Xerox Corporation, Stamford, Conn.

[21] Appl. No.: 09/004,721

[22] Filed: Jan. 8, 1998

[51] Int. Cl.[6] ..... G03G 15/20

[52] U.S. Cl. ..... 399/325; 399/328

[58] Field of Search ..... 399/320, 324, 399/325, 328, 330, 331, 333; 430/124

[56] References Cited

U.S. PATENT DOCUMENTS

| | | | |
|---|---|---|---|
| 3,934,547 | 1/1976 | Jelfo et al. | 118/60 |
| 4,065,585 | 12/1977 | Jelfo et al. | 427/11 |
| 4,214,549 | 7/1980 | Moser | 118/60 |
| 4,272,179 | 6/1981 | Seanor | 399/324 |
| 4,287,280 | 9/1981 | Swift | 399/325 X |
| 4,565,762 | 1/1986 | Kato | 399/324 X |
| 5,017,432 | 5/1991 | Eddy et al. | 428/422 |
| 5,049,944 | 9/1991 | DeBolt et al. . | |
| 5,061,965 | 10/1991 | Ferguson et al. | 399/325 |
| 5,217,837 | 6/1993 | Henry et al. . | |
| 5,219,612 | 6/1993 | Bingham et al. | 427/194 |
| 5,281,506 | 1/1994 | Badesha et al. | 430/124 |
| 5,420,678 | 5/1995 | Rasch et al. | 399/324 |
| 5,500,722 | 3/1996 | Jacobs . | |
| 5,531,813 | 7/1996 | Henry et al. | 106/2 |
| 5,781,840 | 12/1996 | Chen et al. | 399/324 |

*Primary Examiner*—Sandra Brase

[57] ABSTRACT

A heat and pressure fuser and a Release Agent Management (RAM) system therefor. A dual function RAM system is provided. The dual function RAM system supplies functional release agent material having a relatively high concentration of functional chains (in the order of 0.05 to 0.4 mol %) to an elastomeric fuser member as well as release agent material having low funtionality or no functionality. The elastomeric fuser member may contain metal oxide particles. The low functionality release agent is relatively non-reactive. Depending on whether the elastomeric member contains the metal oxide particles, the functional chains of the high concentration release agent material which are periodically supplied to the fuser roll surface either attach to the metal particles exposed at the surface of the fuser roll by chemical bonds or to the elastomeric material itself. The non-reactive chains adhere to the functional chains by much weaker physical (such as van der Waals) chains. The periodic application of the high concentration release agent material includes application for a relatively short duration at machine startup as well as periodically thereafter as needed. Application of the release agent is effected using an elongated web impregnated with alternate bands or areas of silicone oil containing high and low functional chains.

18 Claims, 2 Drawing Sheets

DUAL LEVELS OF FUNCTIONAL AND NON-REACTIVE RELEASE AGENTS FOR FUSERS

BACKGROUND OF THE INVENTION

This invention relates generally to a heat and pressure fuser for an electrophotographic printing machine, and more particularly the invention is directed to the application of release agent and apparatus therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser Roll (NFFR) fuser, the heated fuser roll is provided with a layer or layers that are deformable by a harder pressure roll when the two rolls are pressure engaged. The length of the nip determines the dwell time or time that the toner particles remain in contact with the surface of the heated roll. In a Nip Forming Pressure Roll (NFPR) fuser the pressure roll is provided with a deformable outer layer which is deformable by the harder fuser roll.

The heated fuser roll is usually the roll that contacts the toner images on a substrate such as plain paper. In any event, the roll contacting the toner images is usually provided with an abhesive (low surface energy) material for preventing toner offset to the fuser member. Three materials which are commonly used for such purposes are PFA (PerFluoroAlkoxy resin), Viton™ and silicone rubber. All of these materials, in order to maintain their abhesive qualities, require release agents specific to the material.

Some RAM systems, specifically those designed for Viton™ type fusers, need functional release agents which bond reactively to the fuser roll surface, because non-reactive release agents do not adhere to the low-energy surfaces.

Such functional oils are actually dilute solutions of functional chains (containing groups such as mercapto, amino, etc.) in the conventional non-reactive silicone oil. The functional chains attach to the fuser roll surface by chemical bonds, and the non-reactive chains adhere to the functional chains by much weaker physical (such as van der Waals) chains. Although the functional chains are bonded to the roll, they are eventually removed by the harsh abrasive conditions encountered, and need to be periodically replaced. A certain minimum amount of functional chains (in the order of 0.05 to 0.4 mol %) are required, in order to completely fill the roll surface, without leaving any bare spots which can lead to release failure. Once the roll surface is completely covered with functional chains, only the non-reactive chains need to be replaced continuously as the fuser operates, except for replenishing the few functional chains which are periodically removed from the surface. Therefore in the maintenance mode a far smaller fraction of functional chains is required than in the initial mode.

However, since current RAM systems using functional oils are limited to a single release agent formulation, they are forced to provide the relatively high level (in the order of 0.05–0.4 mol. %) of the functional oils all the time, even in the maintenance mode. The extra functional chains are not bonded to the roll surface because there are no free sites available to them. They are, therefore, passed on to the paper, together with the non-reactive chains. This causes several problems: (1) Cost, because the functional oils are much more expensive than the non-reactive oils; (2) Write-on-copy problems; (3) Stick-on-copy problems, because the functional oils are much more resistant to adhesion than the non-reactive oil and (4) Fuser streaking on OverHead Projector (OHP) transparencies in color copiers/printers in some machines is also attributed to excess functional oil. Number 3 above seems to be related to the functional oils adhering more tenaciously to the paper because of chemical bonding. The stick-on-copy problems are severe enough to jeopardize customer acceptance of certain xerographic imaging machines.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 3,934,547 granted to Jelfo et al on Jan. 27, 1976 and U.S. Pat. No. 4,065,585 granted to Jelfo et al on Dec. 27, 1977 disclose a contact fuser assembly for use in an electrostatic reproducing apparatus including an internally heated fuser roll structure comprising a rigid, thermally conductive core which is coated during operation of the assembly with a thin layer of a normally solid thermally stable material with subsequent application of a liquid release agent to the coated core. In the preferred embodiment of the invention the coating material comprises a fluorocarbon telomer such as Vydax 1000 and the liquid release agent comprises a liquid silicone oil.

U.S. Pat. No. 4,214,549 granted to Rabin Moser on Jul. 29, 1980 discloses a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The heated fuser roll is characterized by an outer layer or surface which by way of example is fabricated from a silicon rubber or Viton™ material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 5,219,612 granted to Patrick J. Finn et al on Jun. 15, 1993 discloses a method of using multilayered member for fusing thermoplastic resin toner images to a substrate in a fuser system of the type wherein a polymeric release agent having functional groups is applied to the surface of the fuser member. The multilayered fuser member has in sequential order a base support member, an adhesive layer comprising a copolymer of vinylidene fluoride and hexafluoropropylene and at least 20% by weight of the adhesive layer of a coupling agent comprising at least one organo functional silane and an activator, a tie coat layer of active ingredients comprising a copolymer of vinylidene fluoride and hexafluoropropylene and an outer elastomeric fusing surface comprising a copolymer of vinylidene fluoride and hexafluoropropylene and containing a metal oxide present in an amount sufficient to interact with a polymeric release agent having functional groups to provide an interfacial barrier layer between said fusing surface and toner.

U.S. Pat. No. 5,217,837 granted to Arnold W. Henry et al on Jun. 8, 1993 discloses a multilayered fuser member for fusing thermoplastic resin toner images to a substrate in a fuser system of the type wherein a polymeric release agent having functional groups is applied to the surface of the fuser member, the fuser member has a base support member, a thermally conductive silicone elastomer layer, an amino silane primer layer, an adhesive layer and a fluoroelastomer surface layer based on the copolymer of vinylidene fluoride and hexafluoropropylene, a metal oxide being present in the fusing surface layer to interact with the polymeric release agent to provide an interfacial barrier layer between the fusing surface and the toner and substantially unreactive with the elastomer.

U.S. Pat. No. 5,017,432 granted to Clifford O. Eddy, on Oct. 29, 1991 relates to a fuser member and fuser system of a type wherein a polymeric release agent having functional groups supplied to the surface of the fuser member has an elastomer fusing surface comprising poly (vinylidenefluoride-hexafluoropropylene-tetrafluoroethylene) wherein the vinylidenefluoride is present in the amount less than 40 mole percent, a metal oxide is present in amounts sufficient to interact with the polymer release agent having functional groups to provide an interfacial barrier layer between the fusing surface and the toner and being substantially unreactive with the elastomer and wherein the elastomer is cured from a solvent solution thereof with a nucleophilic curing agent soluble in the solution and in the presence of less than 4 parts by weight of inorganic base per 100 parts by weight of polymer with the inorganic base being effective to at least partially dehydrofluorinate the vinylidenefluoride.

U.S. Pat. No. 5,531,813 granted Henry, et. al on Jul. 2, 1996 discloses a polyorgano amino functional oil release agent having at least 85% monoamino functionality per active molecule to interacts with the thermally stable FRM hydrofluoroelastomer surface of a fuser member of an electrostatographic apparatus to provide an interfacial barrier layer to the toner and a low surface energy film to release the toner from the surface is introduced herein.

U.S. Pat. No. 5,500,722 granted to Robert M. Jacobs on Mar. 19, 1996 relates to a Release Agent Management (RAM) system for a heat and pressure fuser for fixing black toner images in low and high volume imaging machines and also for fixing color images. An auxiliary oil supply is provided for applying extra oil to an oil impregnated web. The extra oil improves fuser roll release life in every application. Also, enables color fusing which requires higher oil application rates.

U.S. Pat. No. 5,049,944 granted to DeBolt et al on Sept. 17, 1991 discloses an apparatus and method for applying offset preventing liquid to a fuser roll including an oil impregnated web member adapted to be moved by a motor from a supply core to a take up core; and a control to vary the duty cycle operation of the motor to drive the web member at a relatively constant liner speed at a contact nip, the control including a timer to monitor the cumulative time of operation of the motor and to progressively decrease the duty cycle of the motor in response to the cumulative time of operation wherein the progressively decreased duty cycle of operation compensates for the increasing radius of the web member on the take up core to maintain the relatively constant linear speed at the contact nip.

BRIEF SUMMARY OF THE INVENTION

According to the intents and purposes of the present invention, the aforementioned problems are solved by delivering a relatively high concentration of functional chains (in the order of 0.05–0.4 mol. %) in an initial or startup mode of operation of a heat and pressure fuser, and a much lower concentration or zero functional chains in the maintenance or run mode. This will provide the necessary release performance at a lower cost, without the write-on-copy, the transparency streaking and the stick-on-copy problems currently encountered with the use of only functional release agent materials.

One way this can be achieved, as disclosed in U.S. patent application Ser. No. D/97359 (Attorney's Docket No.) is by the provision of two RAM systems, one of which delivers the higher concentration functional chains and the other which delivers a lower (or zero) concentration of functional chains. The high concentration RAM system would be actuated initially (say, at machine startup) and then briefly at periodic intervals (say, every 10 to 1000 prints, or as needed). This will provide a low concentration of functional chains in the maintenance mode, so there will be much fewer of them escaping onto the paper. This will reduce or eliminate the write- on-copy and stick-on-copy problems cited earlier, and the running costs will be lower because of the cheaper non-reactive oil. Fuser streaks may also be reduced. An added benefit is that the functional oil in the initial-mode RAM system would stay much cooler and hence not be susceptible to gelling.

Pursuant to the intents and purposes of the present invention, there is provided for use in a low-cost electrostatic imaging machine, an oil impregnated web instead of the plural RAM systems discussed above. The web is impregnated with alternating bands or areas of non-reactive oil as well as functional oil. The bands extend across the width of the web which is in a direction perpendicular to the direction of transport of the web. The alternating bands or areas are spaced over the web and the functional oil bands are smaller in area than the non-functional oil bands.

DESCRIPTION OF THE PREFERRED EMBODIMENT(S) OF THE INVENTION

Figure 2:
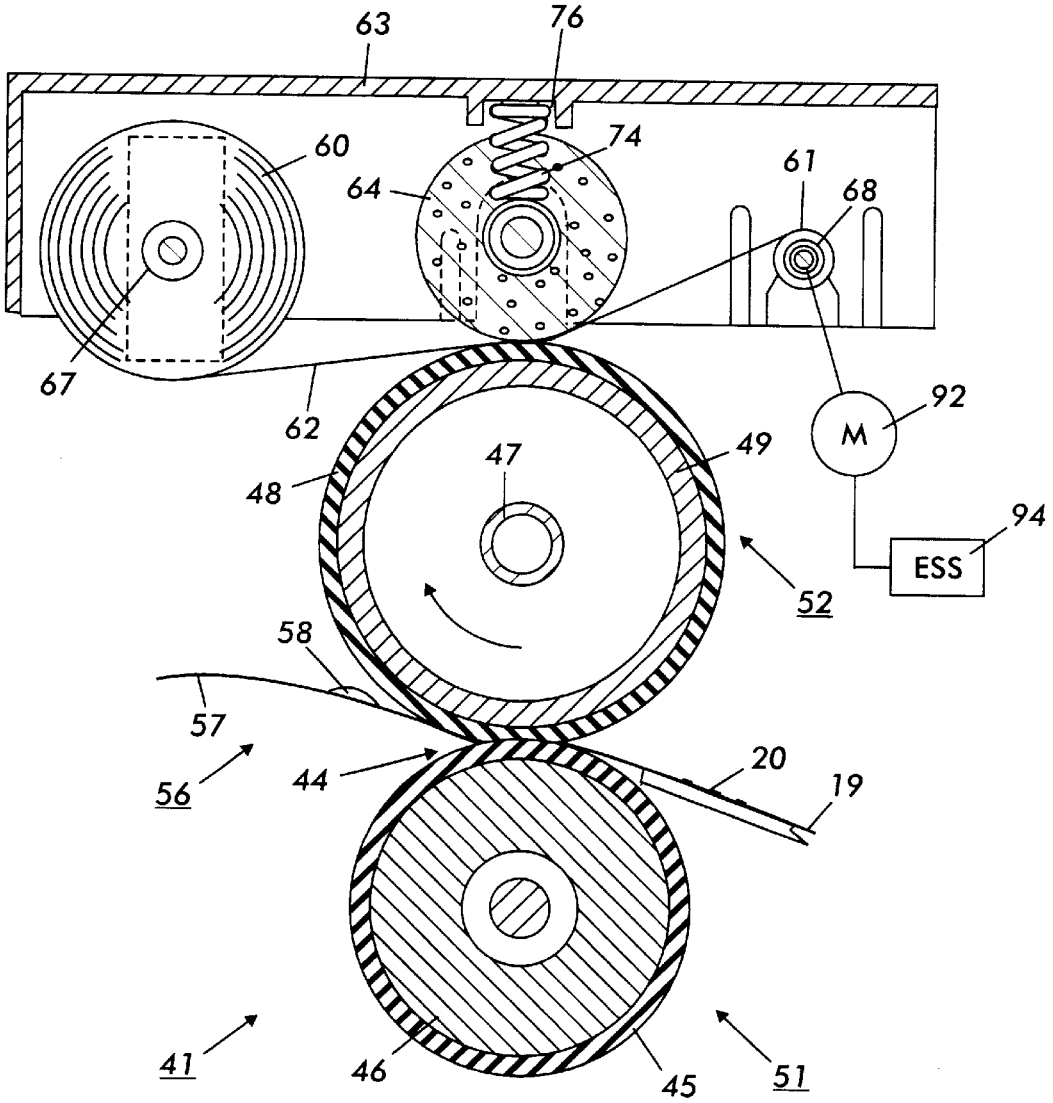
FIG. 2 is a schematic representation of a heat and pressure fuser incorporating the oil impregnated of FIG. 1.

Attention is now directed to FIG. 2 wherein a preferred embodiment of the invention is depicted. As shown in FIG. 2, a fuser roll structure 52 is composed of a core 49 having coated thereon a layer 48 of an elastomeric material. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention. Thus, the fuser member can be heated by internal means, external means or a combination of both. All heating means are well known in the art for providing sufficient heat to fuse the toner to the support. The thin fusing elastomeric layer may be made of any of the well known materials such as PFA, Viton™ and silicone rubber.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on bearings (not shown) which are mechanically biased so that the fuser roll 52 and pressure roll 51 are pressed against each other under sufficient pressure to form a nip in area 44. It is in this nip that the fusing or fixing action takes place. The layer 45 may be made of any of the well known materials such as fluorinated ethylene propylene copolymer or silicone rubber.

The liquid release agent delivery system or RAM system comprises a housing 63 which may typically be a one-piece plastic molded member having mounting elements such as slots or holes for an oil impregnated web 62, supply roll 60, a web take-up roll 61 and an open celled foam pinch roll 64. The web supply roll 60 and web take-up roll 61 are supported in the housing such that when a liquid release agent delivery system is in place, one of rolls 60,61 is on one side of the fuser roll 52 and the other is on the other side of the fuser roll such that the movable web 62 is in contact with the fuser roll 52 along a path parallel to its longitudinal axis. In addition, the movable web 62 is urged into delivery engagement with the fuser roll by the open celled foam pinch roll 64 positioned on the side of the web 62 opposite the fuser roll 52.

The supply roll 60 and take-up roll 61 are each made from interchangeable rotatable tubular support cores 67 and 68 to enable the reversibility of the web. The supply roll core 67 has a supply of release agent impregnated web material 62 wound around the core and is tensioned within the housing to resist unwinding by means of a leaf spring, not shown, at each end of the housing 63 which urges mounting collars, also not shown, into engagement with the rotatable tubular support core 67. The foam pinch roll 64 is spring biased toward the fuser roll by two coil springs 74 (only one shown), one at each end of the pinch roll mounting slot 76 to apply pressure between the web 62 and the fuser roll 52 to insure delivery of an adequate quantity of release agent to the fuser roll.

Any suitable absorbent web material capable of withstanding fusing temperatures of the order of 225° C. may be employed. Typically, the web material is capable of being impregnated with at least 25 grams per square meter of liquid release agent. The web material may be woven or nonwoven and of a sufficient thickness to provide a minimum amount of release agent for a desired life. For example, for a web material capable of holding about 30 grams of release agent per square meter, a thickness of 0.07 millimeters will provide a quantity of release agent capable of fusing about 100,000 prints. It should be understood that the principal function of the web is the delivery of the release agent and that a cleaning function wherein toner and debris are removed from the fuser roll is secondary. The web is advanced by a motor provided for driving the drive shaft of take-up roll 61.

The open celled foam pinch roll may be made of any suitable material which is resistant to high temperatures of the order of the fusing temperature at 220° C. and does not take a permanent set. Typically, it is a molded silicone rubber foam with open cells about 0.5 millimeters in their maximum dimension.

The liquid release agent may be selected from those materials which have been conventionally used. Typical release agents include a variety of conventional used silicone oils including both functional and non-functionally oils. Thus, the release agent is selected to be compatible with the rest of the system. A particularly preferred release agent is an unimodal low molecular weight polysiloxane having a viscosity of about 11,000 centistokes. Such a release agent when used in a release agent delivery system as described above wherein about a 0.07 millimeter thick web is impregnated with at least 25 grams per square meter of release agent and a 20 millimeter diameter open celled, silicone rubber foam roll is also impregnated with the release agent, is consumed at a rate of about 0.3 microliters per copy.

Preferably the web assembly is supplied with a specific length of material already impregnated with the proper amount of oil, rolled on a supply spool with a leader already attached to a take-up roll. This assembly is installed in the machine.

Figure 1:
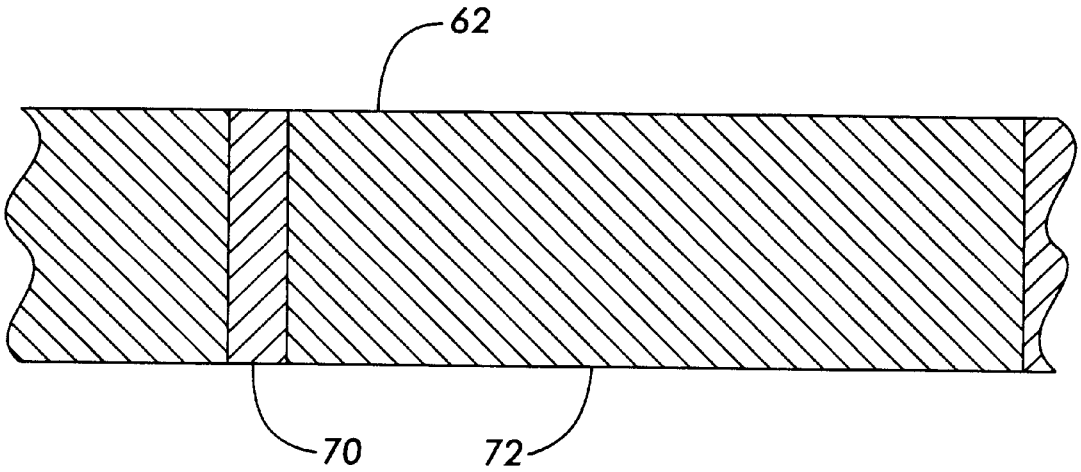
FIG. 1 is a plan view of an oil impregnated web according to the invention.

The web 62, as shown in FIG. 1, is impregnated with alternating bands or areas 70 and 72 of oil, the narrower band 72 containing the functional oil containing functional chains in the order of 0.05–0.4 mol. % and the wider band containing primarily conventional silicone oil containing a few or no functional chains.

A motor 92 and a suitable drive connection are provided for effecting rotation of the roll 61 for transporting the web from the supply roll to the take-up roll. An Electronic SubSystem (ESS) 94 is provided for controlling the operation of the motor 92. Data acquisition, data storage, and computation involved in controlling the advancement of the web 62 and the camming in and out of the camming mechanism 43 are well within the capabilities of present and future microprocessor-based machine controllers.

In operation, the band 72 first contacts the surface of the heated fuser roll member 52 for a predetermined time depending on the particular machine in which it is used. The web 62 is caused to be transported via the motor 92 such that the wider band 72 contacts the surface of the heated fuser roll 52. The wider band contacts the heated fuser roll for a much longer period of time than the narrower band 72. Thus, the heated fuser roll first has functional oil applied to its surface followed by the application of non-functional oil thereto. The longer period of application of the non-functional oil is then followed by another shorter application of more functional oil at a predetermined time. A typical operation scenario would be to have the narrower band 72 contact the heated fuser roll until 10 copies have been made and then have the wider band 74 contact the heated fuser roll until between 10 to 1000 copies have been made depending on the particular machine in which this web RAM system is employed.

While the present invention has been described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

We claim:

1. A heat and pressure fuser structure for use in an imaging apparatus, said fuser structure comprising:

a heated fuser member;

a pressure fuser member supported for pressure contact with said heated fuser member;

an elastomeric material forming an outer layer of one of said fuser members; and a single release agent application structure having an elongated member containing alternate bands of different types of release agent materials, said elongated member being supported for contact with one of said fuser members for the application of release agent materials thereto.

2. A heat and pressure fuser structure according to claim 1 wherein said elongated member comprises an absorbent web.

3. A heat and pressure fuser structure according to claim 1 wherein said bands are of different sizes.

4. A heat and pressure fuser structure according to claim 3 wherein a smaller of said bands contains a high concentration of functional chains and a larger of said bands contains a lesser concentration of functional chains.

5. A heat and pressure fuser structure according to claim 4 wherein the concentration of said functional chains of said release agent material having a relatively high concentration of functional chains is equal to approximately 0.1%.

6. A heat and pressure fuser structure according to claim 5 wherein said large band comprises a relatively low concentration of functional chains.

7. A heat and pressure fuser according to claim 6 wherein said elastomeric material contains metal oxide particles.

8. A heat and pressure fuser according to claim 7 smaller band comprises a dilute solution of functional chains containing mercapto groups.

9. A heat and pressure fuser according to claim 8 wherein said smaller band comprises a dilute solution of functional chains containing amino groups.

10. A release agent management structure, said structure comprising:

an elongated member containing alternate bands of different types of release agent materials.

11. A release agent management structure according to claim 10 wherein said elongated member comprises an oil absorbent web.

12. A release agent management structure according to claim 11 wherein said bands are of different sizes.

13. A release agent management structure according to claim 12 wherein a smaller of said bands contains a high concentration of functional chains and a larger of said bands contains a lesser concentration of functional chains.

14. A release agent management structure according to claim 13 wherein the concentration of said functional chains of said release agent material having a relatively high concentration of functional chains is equal to approximately 0.1%.

15. A release agent management structure according to claim 14 wherein said larger band comprises a relatively low concentration of functional chains.

16. A release agent management structure according to claim 15 wherein said elastomeric material contains metal oxide particles.

17. A release agent management structure according to 16 wherein said smaller band comprises a dilute solution of functional chains containing mercapto groups.

18. A release agent management structure according to claim 11 wherein said smaller band comprises a dilute solution of functional chains containing amino groups.

* * * * *